US012376721B2

(12) United States Patent
Song et al.

(10) Patent No.: US 12,376,721 B2
(45) Date of Patent: Aug. 5, 2025

(54) CLEANER STATION

(71) Applicant: LG ELECTRONICS INC., Seoul (KR)

(72) Inventors: Hyunsup Song, Seoul (KR); Jongjin Woo, Seoul (KR); Jiwoo Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/276,493

(22) PCT Filed: Jan. 21, 2022

(86) PCT No.: PCT/KR2022/001145
§ 371 (c)(1),
(2) Date: Aug. 9, 2023

(87) PCT Pub. No.: WO2022/177185
PCT Pub. Date: Aug. 25, 2022

(65) Prior Publication Data

US 2024/0081595 A1 Mar. 14, 2024

(30) Foreign Application Priority Data

Feb. 22, 2021 (KR) ..... 10-2021-0023534

(51) Int. Cl.
*A47L 9/28* (2006.01)

(52) U.S. Cl.
CPC ..... *A47L 9/2873* (2013.01); *A47L 2201/024* (2013.01)

(58) Field of Classification Search
CPC ... A47L 9/2873; A47L 9/149; A47L 2201/024
See application file for complete search history.

(56) References Cited

U.S. PATENT DOCUMENTS

2018/0160871 A1* 6/2018 Cho ..... A47L 9/1666
2018/0235424 A1 8/2018 Morin et al.
2021/0038034 A1* 2/2021 Na ..... A47L 9/1436

FOREIGN PATENT DOCUMENTS

CN 111603109 9/2020
KR 20-0182558 5/2001
(Continued)

OTHER PUBLICATIONS

Machine translation: KR-200182558; Samsung Gwangju Electronics Co Ltd; (Year: 2001).*
(Continued)

*Primary Examiner* — Natasha N Campbell
(74) *Attorney, Agent, or Firm* — KED & ASSOCIATES, LLP

(57) ABSTRACT

The present disclosure relates to a cleaner station that has a coupling structure in which a dust collector cover is closed by coupling a dust collector. The cleaner station includes a docking unit where a cleaner climbs and is docked; and a station body configured to be connected to one side of the docking unit and sucks dust within a dust bin of the cleaner. The station body includes: a dust collector configured to collect the dust; a dust collector cover that is openable and closeable such that the dust collector enters and exits; and a rotation protrusion of which a portion is exposed to the outside. Accordingly, the dust collector cover can be closed only when the dust collector is coupled, so that a user is able to intuitively recognize whether the dust collector is coupled.

13 Claims, 11 Drawing Sheets

(56) References Cited

FOREIGN PATENT DOCUMENTS

| | | |
|---|---|---|
| KR | 10-2021-0003543 | 1/2021 |
| KR | 10-2021-0016704 | 2/2021 |

OTHER PUBLICATIONS

International Search Report dated May 12, 2022 issued in Application No. PCT/KR2022/001145.
German Office Action Dated Dec. 4, 2024 issued in Application No. 112022000449.5.

* cited by examiner

[FIG. 1]
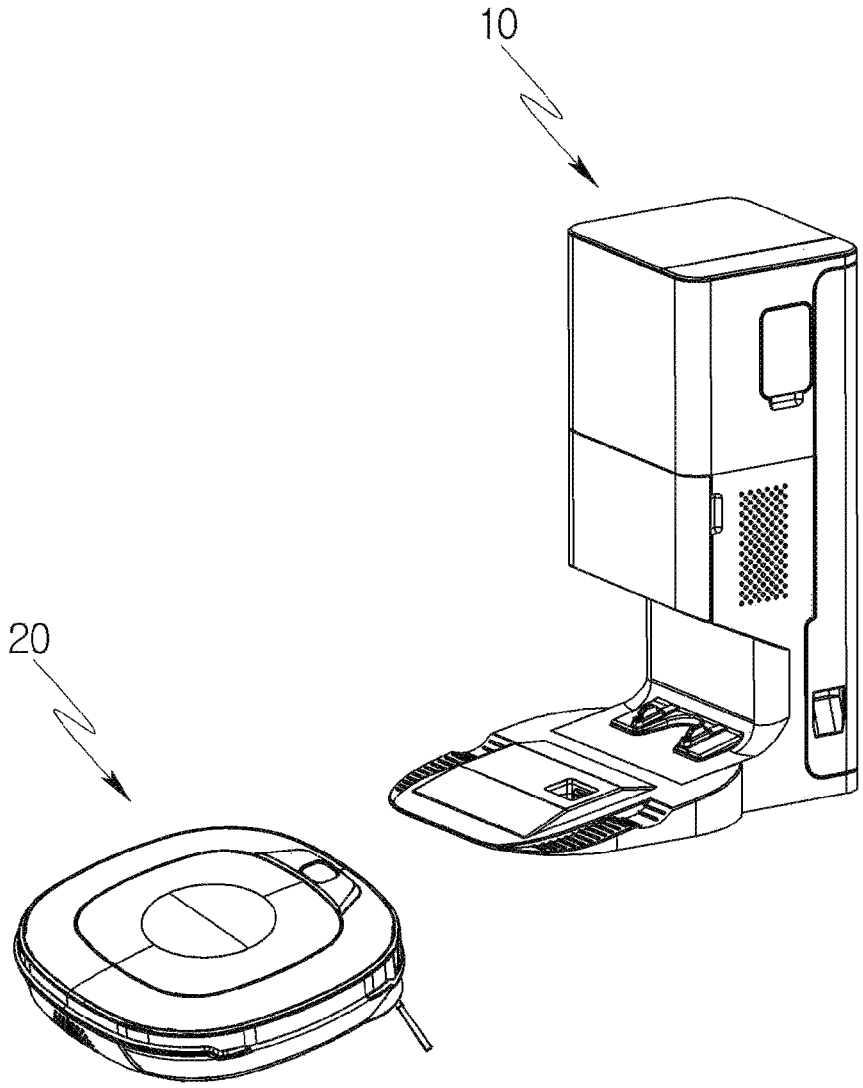

[FIG. 2]
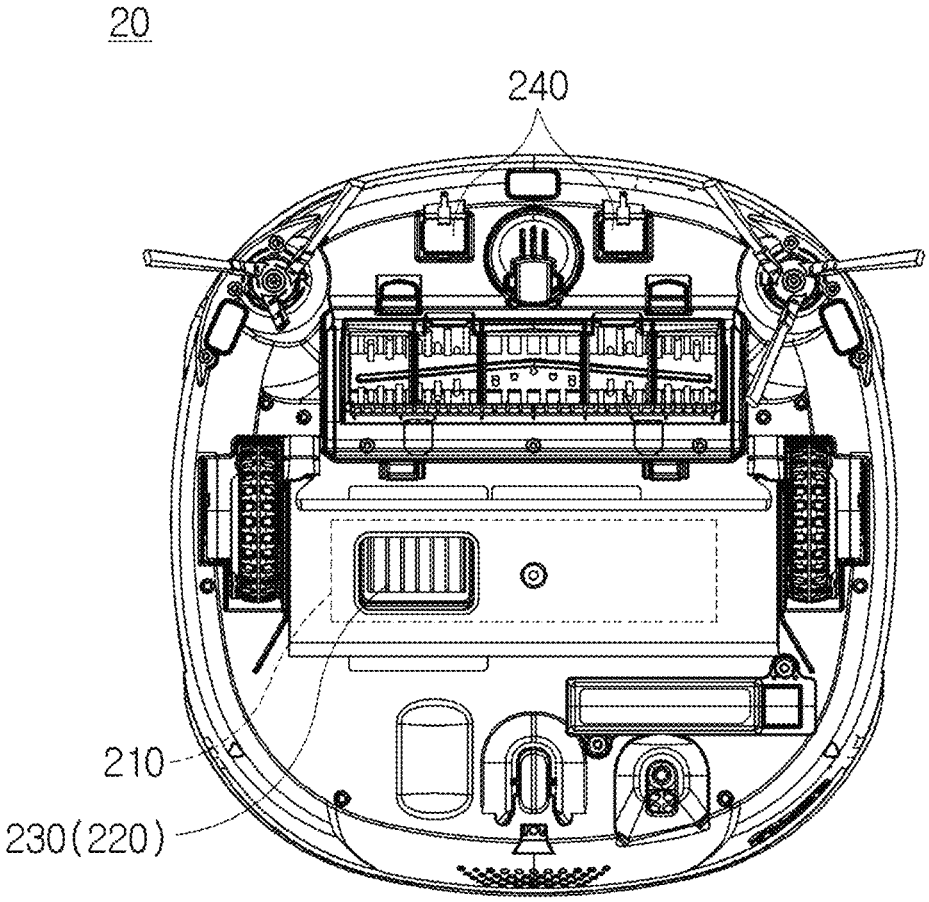

[FIG. 3]
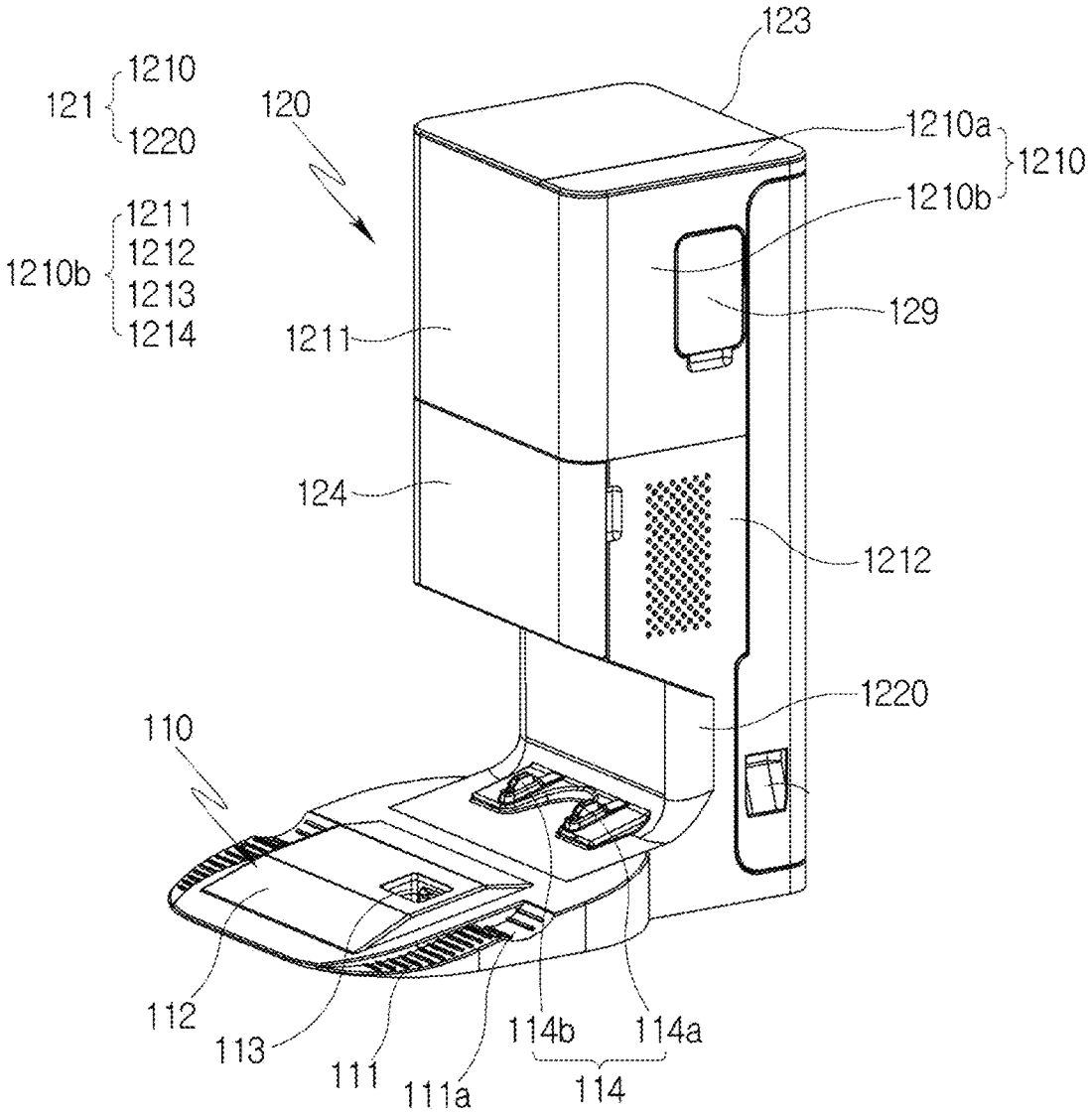

[FIG. 4]
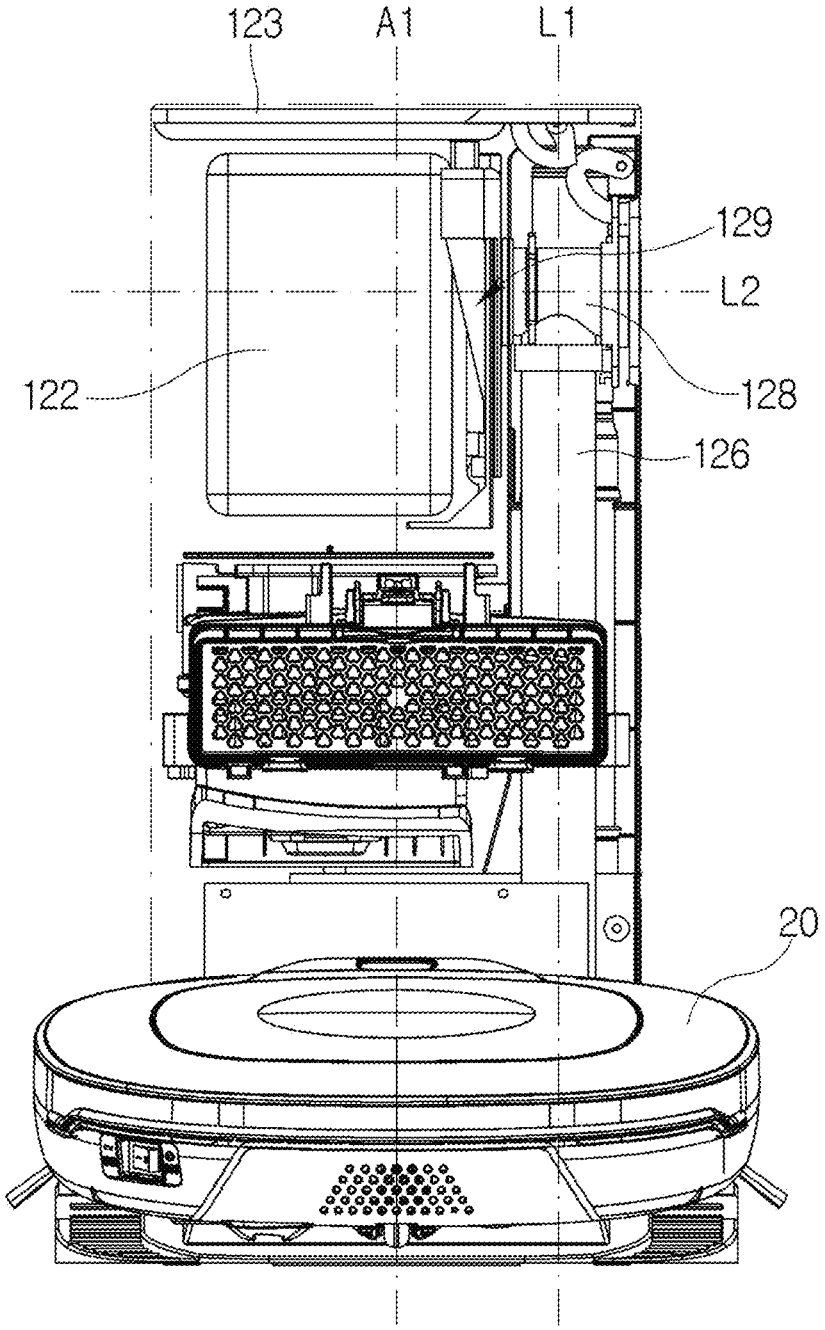

[FIG. 5]
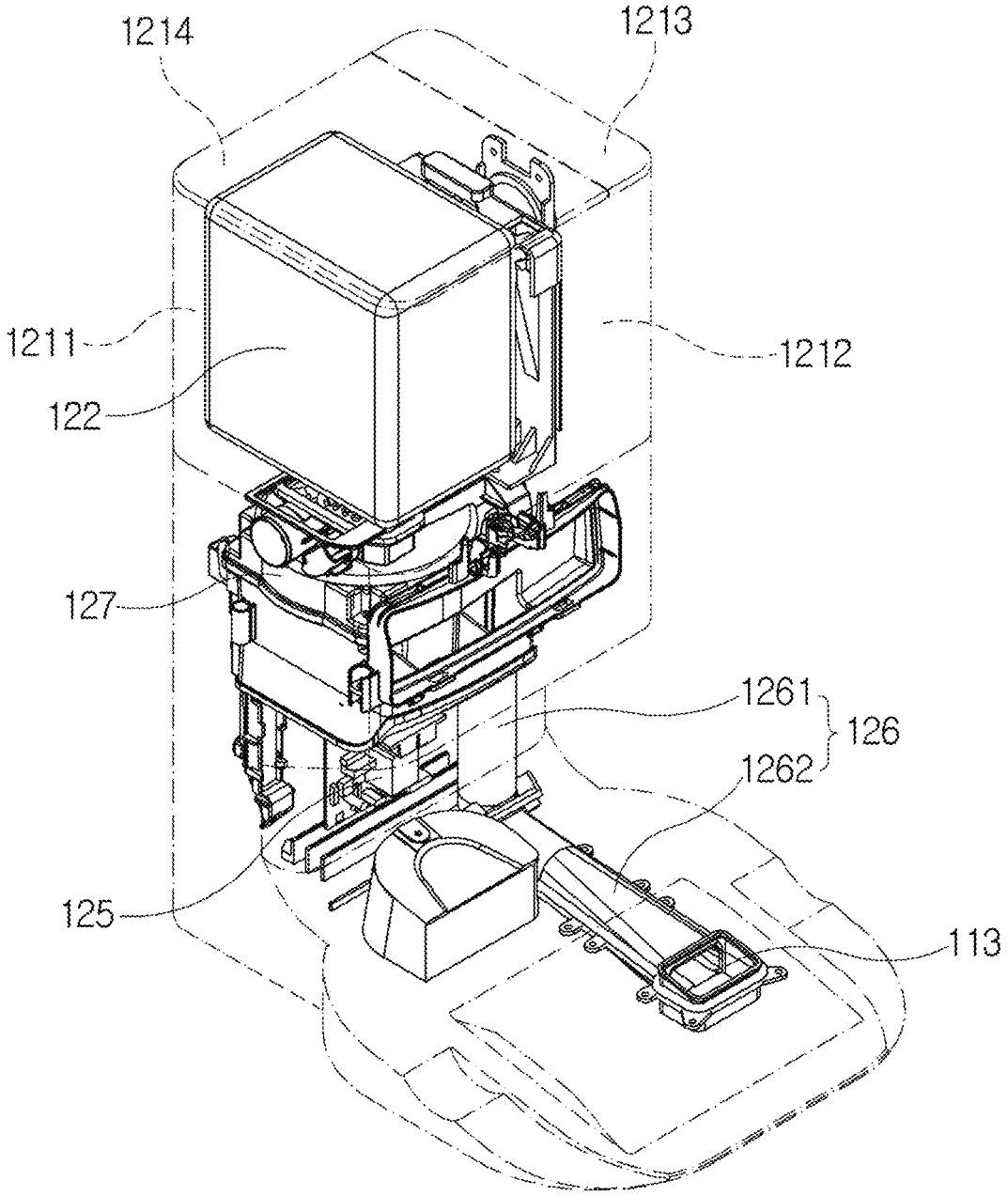

[FIG. 6]
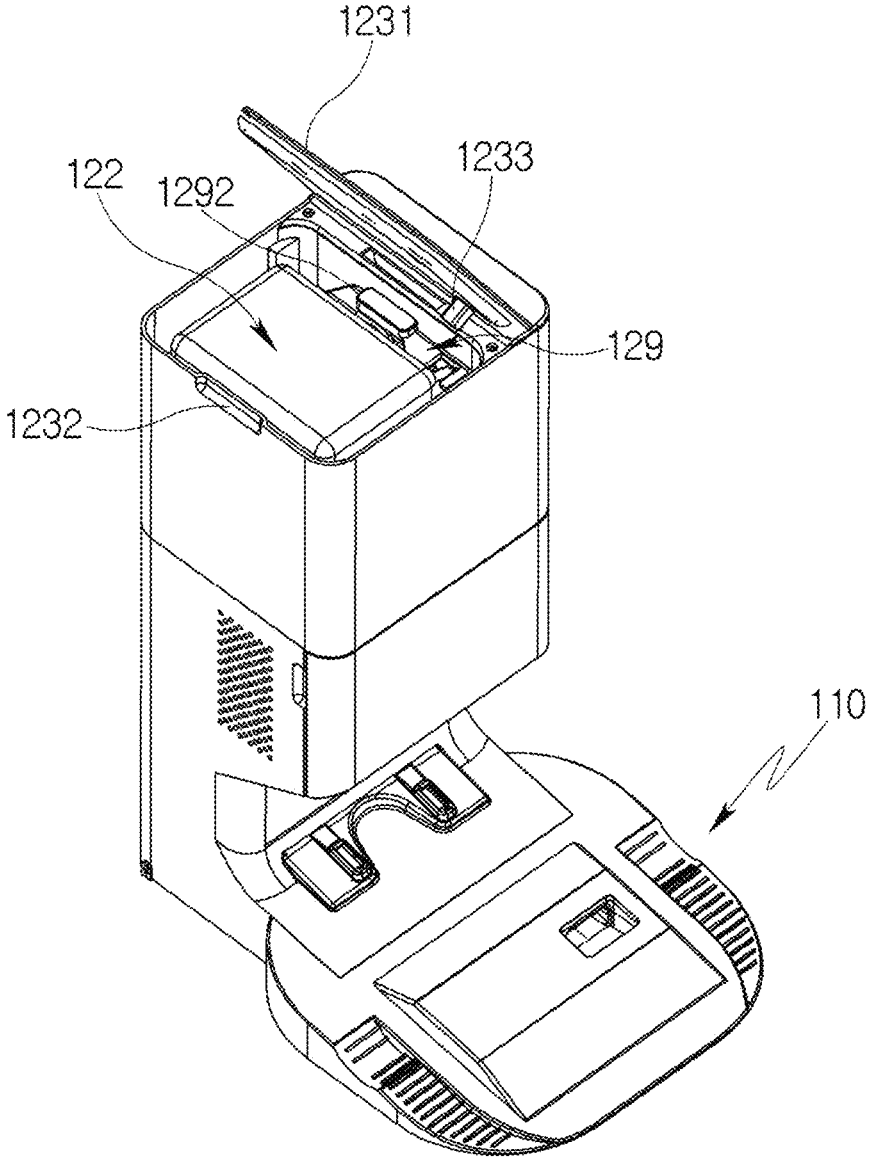

[FIG. 7]
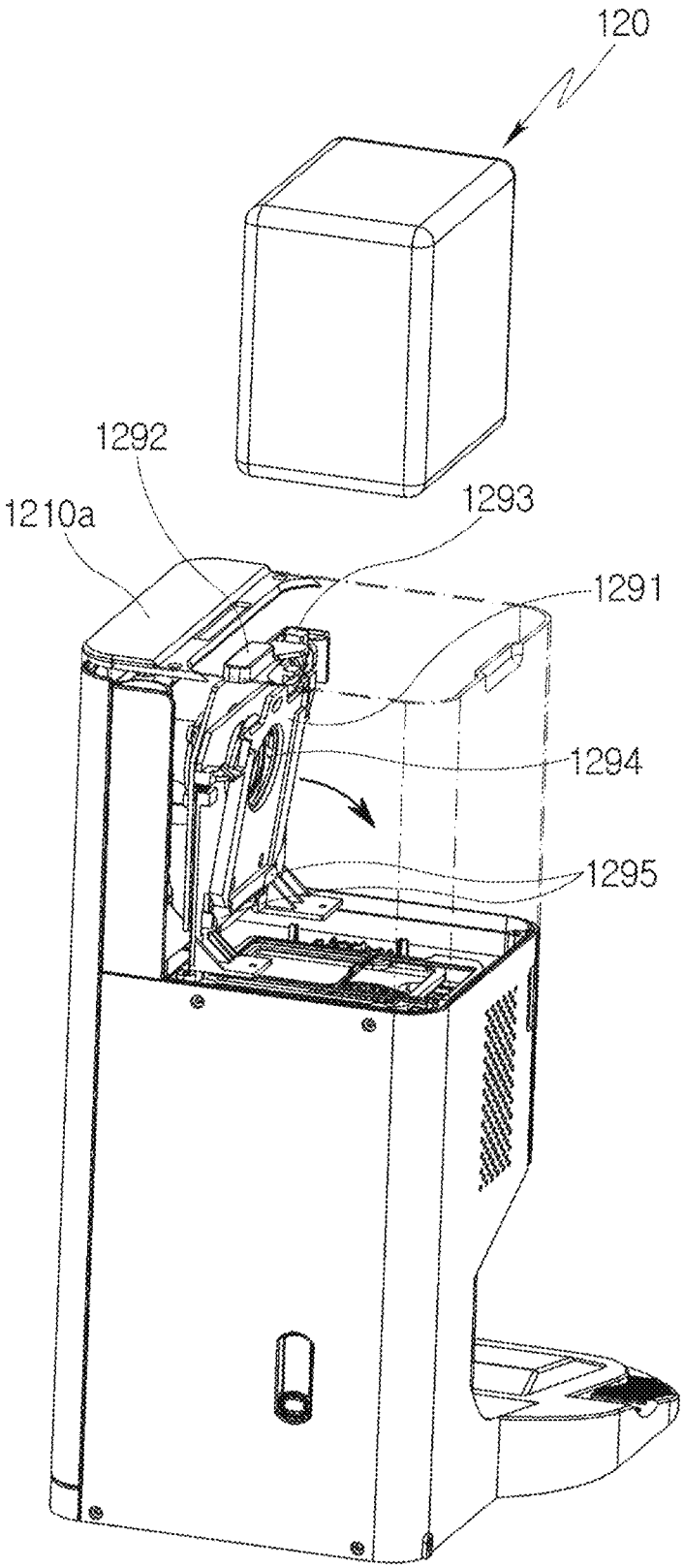

[FIG. 8]
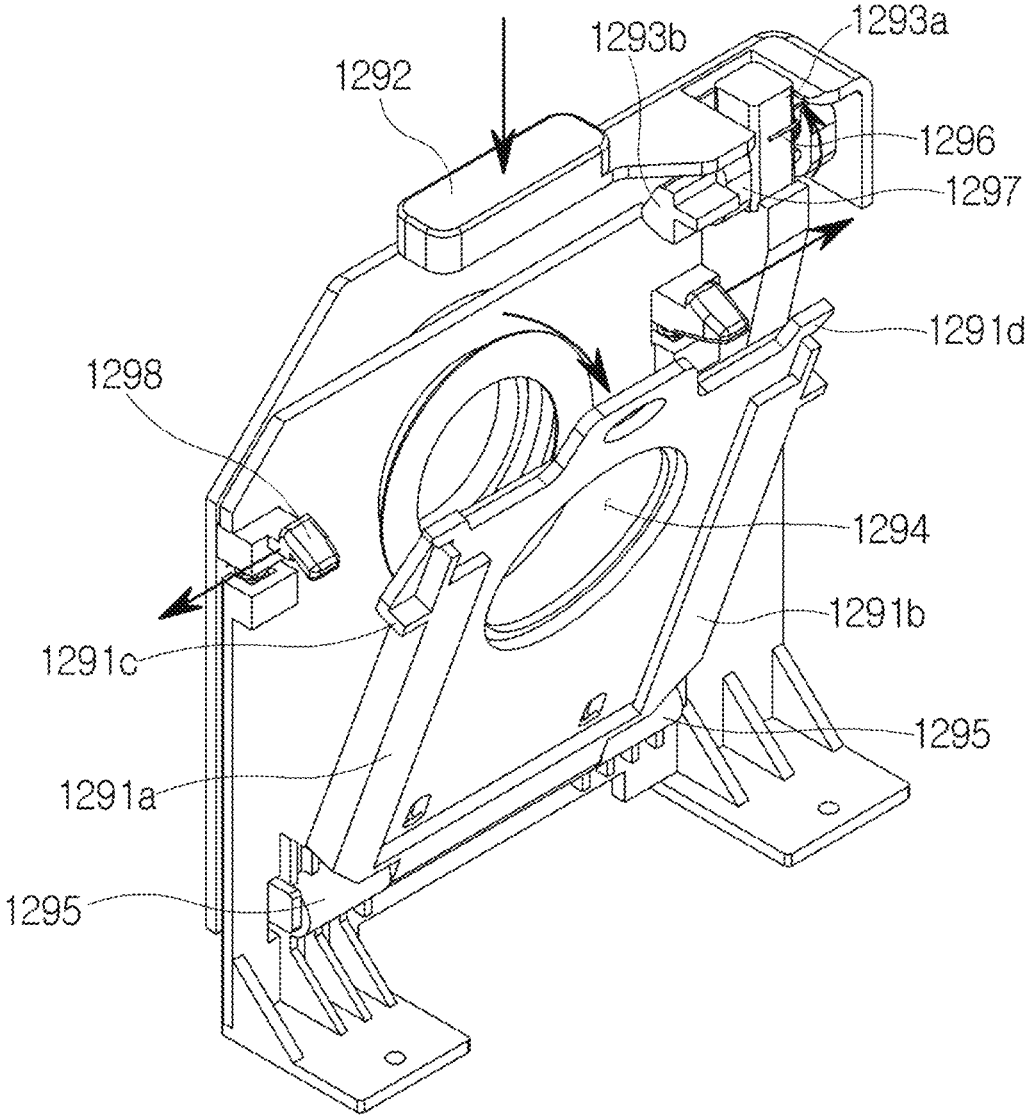

[FIG. 9A]
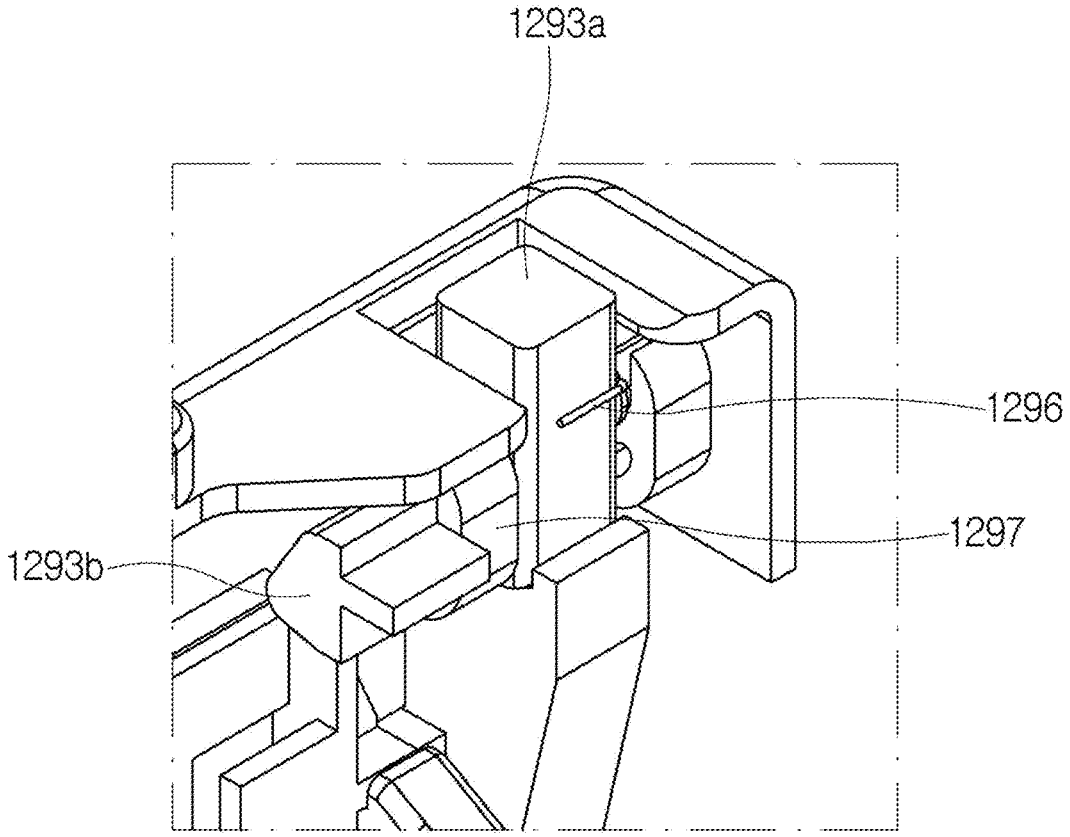

[FIG. 9B]
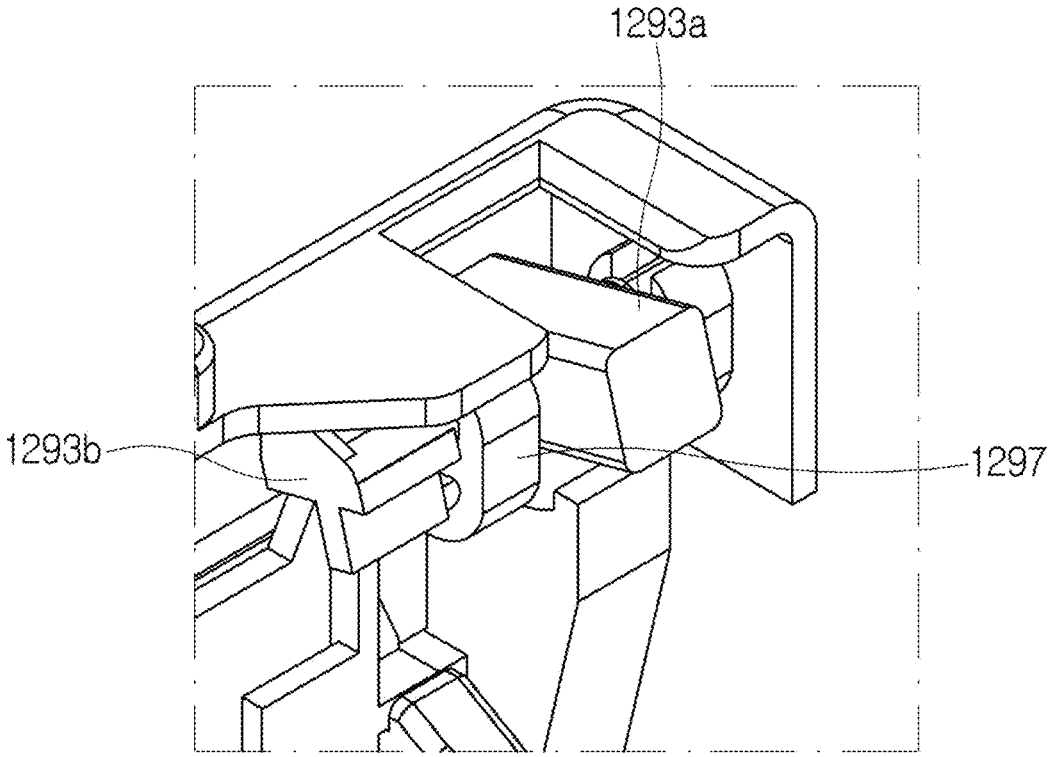

[FIG. 10]
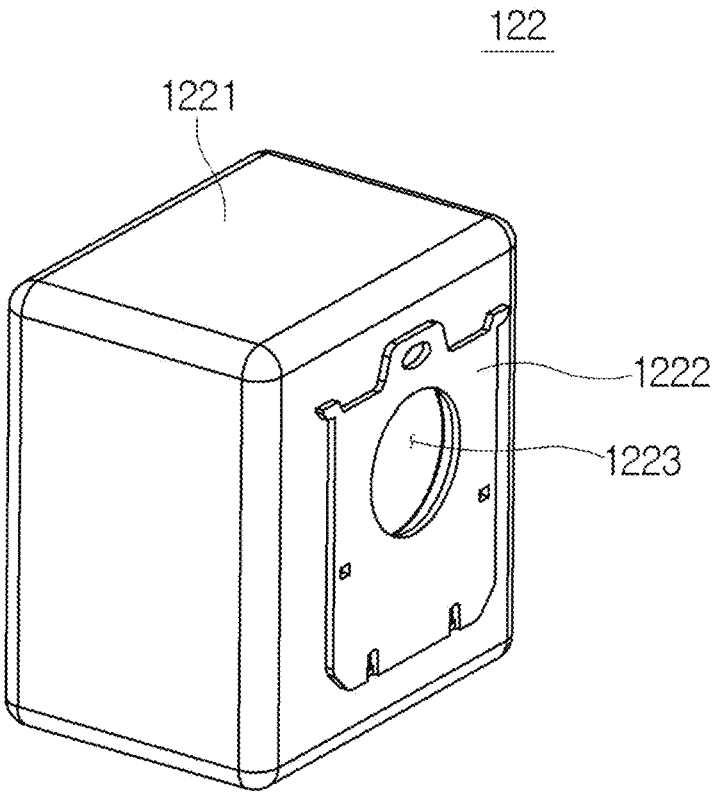

CLEANER STATION

CROSS-REFERENCE TO RELATED PATENT APPLICATIONS

This application is a U.S. National Stage Application under 35 U.S.C. § 371 of PCT Application No. PCT/KR2022/001145, filed Jan. 21, 2022, which claims priority to Korean Patent Application No. 10-2021-0023534, filed Feb. 22, 2021, whose entire disclosures are hereby incorporated by reference.

TECHNICAL FIELD

The present disclosure relates to a cleaner station and more particularly to a cleaner station that has a coupling structure in which a dust collector cover is closed only when a dust collector is coupled.

BACKGROUND ART

In general, a cleaner is a home appliance which sucks tiny trash or dust in a way of sucking air by using electricity and fills the trash or dust in a dust bin included in the cleaner product. The cleaner is usually called a vacuum cleaner.

Such a cleaner can be divided into a manual cleaner which performs cleaning by being moved directly by a user and an automatic cleaner which performs cleaning while travels by itself.

Recently, a robotic vacuum cleaner is generally used which performs cleaning by itself without user's operation. The robotic vacuum cleaner automatically cleans an area to be cleaned by sucking foreign substances such as dust from the floor while traveling on its own in the area to be cleaned.

However, in the conventional stick vacuum cleaner and robotic vacuum cleaner, since the dust bin that stores the collected dust has a small capacity, it is inconvenient for the user to empty the dust bin every time.

In this regard, a prior art document U.S. Ser. No. 10/463,215 discloses an evacuation station that processes dust collected by a robotic vacuum cleaner.

The prior art document discloses the discharge station configured to include a base and a canister connected to the base. The base includes an inclined surface receiving the robotic vacuum cleaner, and the inclined surface is provided with an evacuation intake opening arranged to be connected to a dust bin of the robotic vacuum cleaner.

Also, the prior art document discloses the discharge station that includes a sensor for detecting a filter bag and is controlled not to start an operation when a dust bag is not inserted.

However, according to the prior art document, since a cover can be closed regardless of whether or not the filter bag is inserted, there is a limitation that a user cannot intuitively determine whether or not the filter bag is disposed therein.

Also, since it is difficult to determine whether the filter bag is sealed after being inserted, dust may be sucked into the dust bin of the robotic vacuum cleaner in a state where the filter bag is not sealed and may scatter in the inner space.

DISCLOSURE

Technical Problem

The present disclosure is designed to overcome the problems of a conventional cleaner station described above.

First, the purpose of the present disclosure is to provide a cleaner station in which a dust collector cover is not closed with a dust collector uncoupled.

Second, the purpose of the present disclosure is to provide a cleaner station in which a coupling portion is oblique at a certain angle toward an inner space, in the state where the dust collector is not coupled.

Technical Solution

One embodiment is a cleaner station including: a docking unit where a cleaner enters and is docked; and a station body configured to be connected to one side of the docking unit and process dust within a dust bin of the cleaner. The station body includes: a housing; a suction tube configured to be coupled to the docking unit and to suck the dust within the dust bin of the cleaner; a dust collector configured to collect the dust sucked by the suction tube; and a coupling portion which is configured to be provided within the housing and to which the dust collector is coupled. The housing includes a dust collector cover that is openable and closeable such that the dust collector enters and exits. The coupling portion includes a rotation protrusion of which at least a portion is exposed to the outside of the station body. When the dust collector is coupled, the rotation protrusion is rotated and is concealed from the outside.

Here, the dust collector cover may be disposed above the dust collector on the basis of the direction of gravity of the dust collector.

Also, the coupling portion may further include an insertion portion that is hinge-coupled to an inner surface of the station body. The dust collector may include: a dust collector body configured to form an inner space where dust is collected; and a catching part configured to be connected to the dust collector body and is coupled to the insertion portion.

Also, the insertion portion may have a groove in which the catching part is fitted and received.

Also, the coupling portion may further include: a pressing device disposed above the insertion portion; and at least one hook configured to fix the insertion portion. When a user presses the pressing device, the hook releases the fixing of the insertion portion.

Here, the insertion portion may be provided to be rotated by a predetermined angle about an insertion portion hinge connected to a lower portion thereof.

The coupling portion may further include a fixing pin for guiding a position of the rotation protrusion.

Also, the coupling portion may further include a pressing device configured to be disposed above the insertion portion. When a user presses the pressing device, the fixing pin releases the fixing of the rotation protrusion.

Meanwhile, the dust collector cover may include: a cover body; a cover grip portion provided on one side of the cover body; and a cover hinge provided on the other side of the cover body, facing the cover grip portion.

Here, the cover grip portion may be provided in a shape of a groove recessed to a predetermined depth such that a user is able to grip the cover grip portion.

Also, the cover hinge may be rotatable about the cover hinge as a central axis by 90° or more and 180° or less on the basis of a state of being closed.

Meanwhile, the coupling portion may further include at least one hook configured to fix the insertion portion. The hook may catch and fix the catching part and the insertion portion together.

Here, the coupling portion may further include a pressing device disposed above the insertion portion. When a user presses the pressing device, the hook releases the fixing of the catching part from the insertion portion.

Another embodiment is a cleaner station including: a docking unit where a cleaner enters and is docked; and a station body configured to be connected to one side of the docking unit and process dust within a dust bin of the cleaner. The station body may include: a housing; a suction tube configured to be coupled to the docking unit and to suck the dust within the dust bin of the cleaner; a dust collector configured to collect the dust sucked by the suction tube; and a coupling portion which is configured to be provided within the housing and to which the dust collector is coupled. The coupling portion may be disposed such that an upper portion thereof is inclined toward an inner space of the housing at a predetermined angle, in a state of being separated from the dust collector.

Advantageous Effect

According to the embodiments of the present disclosure, a user is able to intuitively recognize whether the dust collector is coupled. Therefore, there is an effect of preventing the damage of a filter or a motor due to a malfunction.

Also, a station is operated with the dust collector uncoupled, so that it is possible to prevent the contamination of the inner space.

Also, the insertion portion can be coupled to the dust collector in a state of being oblique forward, so that the user is able to couple the dust collector more conveniently.

DESCRIPTION OF DRAWINGS

FIG. 1 is a perspective view of a cleaner system including a station according to an embodiment of the present disclosure;

FIG. 2 is a bottom view of a cleaner that is coupled to the cleaner station according to the embodiment of the present disclosure;

FIG. 3 is a perspective view of the cleaner station according to the embodiment of the present disclosure;

FIG. 4 is a front view of the cleaner station according to the embodiment of the present disclosure;

FIG. 5 is a view showing a structure in which a dust bin and a suction tube of the cleaner are connected in the cleaner station according to the embodiment of the present disclosure;

FIG. 6 is a perspective view showing that a dust collector cover of the cleaner station according to the embodiment of the present disclosure is opened;

FIG. 7 is a view showing that a dust collector is separated from the cleaner station according to the embodiment of the present disclosure;

FIG. 8 is a perspective view showing a coupling portion of the cleaner station according to the embodiment of the present disclosure;

FIGS. 9A and 9B are enlarged perspective views of a rotation protrusion in a state where the dust collector is separated from the cleaner station according to the embodiment of the present disclosure; and FIG. 10 shows the dust collector of the cleaner station according to the embodiment of the present disclosure.

MODE FOR INVENTION

Hereinafter, preferred embodiments of the present invention will be described in detail with reference to the accompanying drawings.

As the present invention can have various embodiments as well as can be diversely changed, specific embodiments will be illustrated in the drawings and described in detail. While the present invention is not limited to particular embodiments, all modification, equivalents and substitutes included in the spirit and scope of the present invention are understood to be included therein.

Terms used in the present specification are provided for description of only specific embodiments of the present invention, and not intended to be limiting. An expression of a singular form includes the expression of plural form thereof unless otherwise explicitly mentioned in the context.

Unless otherwise defined, all terms used herein including technical and scientific terms have the same meaning as commonly understood by one of ordinary skill in the art to which the present invention belongs. Terms, for example, commonly used terms defined in the dictionary, are to be construed to have exactly the same meaning as that of related technology in the context. As long as terms are not clearly defined in the present application, the terms should not be ideally or excessively construed as formal meaning.

FIG. 1 is a perspective view of a cleaner system including a station according to an embodiment of the present disclosure. FIG. 2 is a bottom view of a cleaner that is coupled to the cleaner station according to the embodiment of the present disclosure.

Referring to FIGS. 1 and 2, a cleaner system 1 may include a cleaner station 10 and a cleaner 20. Meanwhile, the cleaner system 1 according to the embodiment of the present disclosure may further include a cleaning module 30 (not shown) and a second cleaner 40 (not shown). The embodiment may be implemented without some of the components and does not exclude additional components.

The cleaner station 10 is a device configured to perform an operation of sucking and removing dust within a dust bin 210 of the cleaner 20. For dust suction operation, the cleaner 20 may be docked to the cleaner station. Here, the cleaner 20 docked to the cleaner station 10 may be a robotic vacuum cleaner that performs a cleaning operation while traveling autonomously.

The cleaner 20 automatically cleans an area to be cleaned by sucking foreign substances such as dust from the floor while traveling on its own in the area to be cleaned. The cleaner 20 may include a distance sensor that detects a distance to an obstacle, such as furniture, office supplies, or walls, etc., installed in the cleaning area, a main wheel, and an auxiliary wheel for movement. The cleaner 20 may be docked or coupled to the cleaner station 10. Dust sucked into the dust bin 210 of the cleaner 20 may be collected into the cleaner station 10 through a suction hole 113 to be described later.

The cleaner 20 may include a dust discharge hole 220. Here, the dust discharge hole 220 may be disposed on a bottom surface of the dust bin 210 of the cleaner 20, and through this, the dust bin 210 of the cleaner 20 and a suction tube 126 to be described later may be in communication with each other. For example, the dust discharge hole 220 may have a quadrangular hole shape.

The cleaner 20 may include a discharge cover 230. Here, the discharge cover 230 may be formed in a shape corresponding to the dust discharge hole 220 and may close the dust discharge hole 220. To this end, the discharge cover 230 may be disposed in the dust discharge hole 220. In addition, one side of the discharge cover 230 may be fixed to the dust discharge hole 220 and may form a fixed end, and the other side may form a free end. Through this configuration, when a suction force is generated toward the dust bin 210 of the cleaner 20, the free end can move downward while the fixed end is fixed, and the dust discharge hole 220 can be opened. When the suction force directed toward the dust bin 210 of the cleaner 20 disappears, the free end of the discharge cover 230 moves upward to block the dust discharge hole 220 again. In this way, according to the moving direction of the free end, the discharge cover 230 may communicate with or close the dust bin 210 and the suction tube 126 of the cleaner 20.

The cleaner 20 may include a corresponding terminal 240 which is docked to the cleaner station 10 and charges a battery. The corresponding terminal 240 may be disposed at a position that enables the corresponding terminal 240 to be connected to a charging terminal of the cleaner station 10 in a state where the cleaner 20 is docked. For example, the corresponding terminals 240 may be arranged on a bottom surface of the cleaner 20 in the form of a pair. When the corresponding terminal 240 and the charging terminal are electrically connected, power is supplied from a power supply of the cleaner station 10 to the cleaner 20, so that the battery of the cleaner 20 can be charged.

FIG. 3 is a perspective view of the cleaner station according to the embodiment of the present disclosure. FIG. 4 is a front view of the cleaner station according to the embodiment of the present disclosure. FIG. 5 is a view showing a structure in which the dust bin and the suction tube of the cleaner are connected in the cleaner station according to the embodiment of the present disclosure.

Prior to the description of the specific configuration of the cleaner station 10, a direction that will be described throughout this specification is defined first. When a direction in which the cleaner 20 moves in order to be docked to the cleaner station 10 is defined as a forward direction, one side where the cleaner 20 is docked to the cleaner station 10 may be defined as a front. Also, a direction opposite to the front may be referred to as a rear. Also, a direction parallel to a major axis A1 of a station body 120 may be defined as an up and down direction.

Hereinafter, the configuration of the cleaner station 10 will be described in detail.

Referring to FIG. 3, a cleaner station 10 according to an embodiment of the present invention may include a docking unit 110 and the station body 120.

The docking unit 110 is a component where the cleaner 20 enters and is docked. The cleaner 20 may approach from the front of the docking unit 110, may climb the docking unit 110, and may be seated on a top surface of the docking unit 110. The docking unit 110 is formed to be inclined upward, and the cleaner 20 may enter through an operation such as climbing.

The top surface of the docking unit 110 may have a shape similar to the outer shape of the cleaner 20. For example, the top surface may be formed to have a shape similar to a quadrangle. However, it is obvious that the shape of the docking unit 110 is not limited thereto and the docking unit 110 may be provided in a shape that is not similar to the outer shape of the cleaner 20 as needed.

Not only the top surface of the docking unit 110 where the cleaner 20 climbs but also a side surface extending downward from the edge of the top surface and a bottom surface which is in contact with the ground where the cleaner station 10 is installed may form an inner space. As will be described later, the inner space of the docking unit 110 may receive a portion of the suction tube 126.

The docking unit 110 may include a rolling part 111 through which left and right wheels of the cleaner 20 pass when the cleaner 20 moves for docking. The rolling part 111 may be disposed at the left and right ends of the docking unit 110 when the docking unit 110 is viewed from the front. A distance between the left and right rolling parts 111 may correspond to a distance between the left and right wheels of the cleaner 20 such that the movement of the left and right wheels of the cleaner 20 can be guided.

In addition, the rolling part 111 may be recessed further downward than the top surface of the docking unit 110 such that the left wheel and the right wheel of the cleaner 20 do not deviate from a path when docking. That is, the rolling part 111 may be defined as a concave-downward region, compared to other regions of the docking unit 110 which are adjacent to the cloud unit 111.

Also, a wheel seating portion 111*a* may be provided on the rolling part 111. The wheel seating portion 111*a* supports the left and right wheels of the cleaner 20 such that the cleaner 20 does not move in a docked state. The wheel seating portion 111*a* may be defined as a concave curved region so as to surround and support the left and right wheels of the cleaner 20 on the rolling portion 111.

A plurality of protrusions protruding upward at predetermined intervals may be provided on the top surface of the rolling part 111. The plurality of protrusions may form irregularities on the rolling part 111 to prevent slipping of the left and right wheels.

The docking unit 110 may include an inclined portion 112 disposed at the center of the docking unit 110. The inclined portion 112 may be formed by protruding and extending upward from the top surface of the docking unit 110. The inclined portion 112 may include a plurality of inclined surfaces having different inclinations, and a degree of inclination of each of the plurality of inclined surfaces may be determined according to the outer shape of the bottom surface of the cleaner 20.

The docking unit 110 includes the suction hole 113 provided at a position corresponding to a position where the dust bin 210 of the cleaner 20 is disposed based on a state in which the cleaner 20 is docked to the docking unit 110. More specifically, the suction hole 113 may be disposed in the inclined portion 112 and may be disposed at a position corresponding to a position where the dust discharge hole 220 of the cleaner 20 is disposed when the cleaner 20 is docked. The suction hole 113 may be provided in a shape corresponding to the dust discharge hole 220 of the cleaner 20. For example, the suction hole 113 may have a quadrangular hole shape.

The docking unit 110 may include a charging unit 114 which is electrically connected to the cleaner 20 and supplies power to charge the cleaner 20. The charging unit 114 may include charging terminals 114*a* and 114*b* provided on the left and right sides of the docking unit 110 respectively when the docking unit 110 is viewed from the front.

When the cleaner 20 is docked to the docking unit 110, the corresponding terminal 240 of the cleaner 20 and the charging terminals 114*a* and 114*b* are electrically connected to each other, and a power module 125 provided within the station body 120 supplies power to the cleaner 20, so that the cleaner 20 can be charged. A distance between the left and right charging terminals 114*a* and 114*b* may be substantially the same as that a distance between the corresponding terminals 240 of the cleaner 20.

The station body 120 is connected to the docking unit 110 at one side of the docking unit 110 and is configured to suck dust from the dust bin 210 of the cleaner 20 into the inside thereof. More specifically, the station body 120 may be connected to the rear of the docking unit 110. Also, the station body 120 may be provided in a shape protruding upward and may form the major axis A1 which is disposed to extend in the up and down direction.

The station body 120 may include a housing 121 in which a dust collector 122 which collects dust is disposed. The housing 121 may include a main housing 1210 composed of a plurality of outer walls.

Here, the main housing 1210 can receive and protect various parts in the inner space surrounded by the plurality of outer walls. Also, the main housing 1210 may form an outer shape of the station body 120 through the plurality of outer walls.

For example, the main housing 1210 may have an outer shape substantially similar to a quadrangular column. An edge of the main housing 1210 may be formed in a streamlined shape for safety of users and aesthetics. However, the outer shape of the main housing 1210 may be variously changed within a range capable of forming an inner space of the cleaner station 10, and of receiving and protecting the parts.

The station body 120 may further include the dust collector 122. As described above, the dust collector 122 may be received within the housing 121. The dust collector 122 may be detachably coupled to the main housing 1210. A specific shape of the dust collector 122 will be described later with reference to FIG. 10.

Meanwhile, the plurality of outer walls constituting the main housing 1210 may include an upper wall 1210*a* and a body sidewall 1210*b*.

The upper wall 1210*a* may form an upper outer shape of the station body 120. The upper wall 1210*a* may refer to a component that includes a surface disposed on the uppermost side of the station body 120 in the direction of the major axis A1 and is exposed to the outside. Here, the upper wall 1210*a* can be disposed parallel to the ground or inclined at a predetermined angle with the ground.

A portion of the upper wall 1210*a* may be provided to be openable and closeable. For example, the station body 120 may include a dust collector cover 123. The dust collector cover 123 may be disposed to open and close a portion of the upper wall 1210*a* in order to expose the dust collector 122 received in the inner space of the main housing 1210 to the outside.

Since the user can separate the dust collector 122 from the inner space of the main housing 1210 with the above configuration, it is easy to replace the dust collector 122. That is, the dust collector 122 may be provided as a consumable part. A process in which the user opens the dust collector cover 123 and couples and separates the dust collector 122 will be described later in detail with reference to FIG. 6 and the following figures.

The body sidewall 1210*b* may form a side outer shape of the main housing 1210. For example, when the main housing 1210 has a quadrangular column shape, the body sidewall 1210*b* may include a first body sidewall 1211 disposed in the front thereof, and may further include a second body sidewall 1212, a third body sidewall 1213, and a fourth body sidewall 1214 which are sequentially arranged in a counterclockwise direction in a state where the first body sidewall 1211 is viewed. (See FIG. 5)

A portion of the body sidewall 1210*b* may be provided to be openable and closeable. For example, the station body 120 may further include a HEPA filter cover 124. The HEPA filter cover 124 may be disposed to open and close a portion of the first body sidewall 1211 in order to expose a HEPA filter (not shown) received in the inner space of the main housing 1210 to the outside. With this configuration, since the HEPA filter can be separated from the inner space of the main housing 1210, it is easy to replace or clean the HEPA filter.

The housing 121 may further include a connector housing 1220.

A front of the connector housing 1220 is provided in the form in which a step difference is formed by concavely bending the first body sidewall 1211 backward, and may be connected to the docking unit 110. With this configuration, a space in which the cleaner 20 is docked to the docking unit 110 can be further secured, and the entire forward and backward length of the cleaner station 10 can be reduced, which is advantageous in space utilization. Both sides of the connector housing 1220 may be integrally formed with the second body sidewall 1212 and the fourth body sidewall 1214, and the rear of the connector housing 1220 may be integrally formed with the third body sidewall 1213. The connector housing 1220 may form an inner space surrounded by the front, both sides and rear thereof.

The station body 120 may further include the power module 125. Here, the power module may be received in the inner space of the connector housing 1220. With this configuration, it is possible to minimize a distance between the power module 125 and the charging unit 114, so that there is an advantage of simplifying an electrical connection structure.

The station body 120 may further include the suction tube 126.

The suction tube 126 may serve as a flow path that is coupled to the docking unit 110 and sucks dust within the dust bin 210 of the cleaner 20 into the dust collector 122. One side end of the suction tube 126 is coupled to the suction hole 113 of the docking unit 110, so that, when the cleaner 20 is docked to the cleaner station 10, the suction tube 126 and the dust bin 210 of the cleaner 20 can be in communication with each other.

The suction tube 126 may include a first suction tube 1261 and a second suction tube 1262. A longitudinal axis of the first suction tube 1261 may be arranged parallel to the major axis A1 (that can be used as the same meaning as the major axis of the main housing 1210 or the major axis of the station body 120) of the housing 121. (See FIG. 4) When the second suction tube 1262 is connected to the first suction tube 1261 and extends through the inner space of the docking unit 110 and then the cleaner 20 is docked to the docking unit 110, the second suction tube 1262 can be connected to the dust bin 210 of the cleaner 20. The first suction tube 1261 may be disposed in the inner space of the housing 121.

The station body 120 may further include a dust collection motor 127.

The dust collection motor 127 may be disposed within the housing 121. The dust collection motor 127 may generate a suction force such that the dust within the dust bin 210 of the cleaner 20 is sucked through the suction tube 126. More specifically, the dust collection motor 127 may be disposed within the main housing 1210 and below the dust collector 122.

When the dust collection motor 127 is driven, a suction force directed from the dust collector 122 toward the dust collection motor 127 may be generated. As described above, a lower end of the first suction tube 1261 is connected to one side end of the second suction tube 1262 and the other side end of the second suction tube 1262 is connected to the dust discharge hole 220 of the docking unit 110. Therefore, when the dust collection motor 127 is driven, the dust within the dust bin 210 of the cleaner 20 can be sucked through a flow path leading to a connection tube 128, the first suction tube 1261, and the second suction tube 1262.

FIG. 6 shows that the dust collector cover of the cleaner station according to the embodiment of the present disclosure is opened. FIG. 7 shows that the dust collector is separated from the cleaner station according to the embodiment of the present disclosure. FIG. 8 shows a coupling portion of the cleaner station according to the embodiment of the present disclosure. FIGS. 9A and 9B are enlarged views of a rotation protrusion in a state where the dust collector is separated from the cleaner station and in a state where the dust collector is coupled to the cleaner station according to the embodiment of the present disclosure. FIG. 10 shows the dust collector of the cleaner station according to the embodiment of the present disclosure.

Referring first to FIG. 6, in the embodiment of the present invention, the dust collector cover 123 provided on the top of the cleaner station 1 may be opened. Accordingly, the inner space of the station body 120 may be exposed to the outside. Specifically, the dust collector 122 and a coupling portion 129 provided within the station body 120 may be exposed to the outside.

The dust collector cover 123 may include a cover body 1231, a cover grip portion 1232, and a cover hinge 1233.

The cover body 1231 may form a portion of the outer shape of the cleaner station 10. Accordingly, the cover body 1231 can separate the inner space of the station body 120 from the outside.

The cover grip portion 1232 may be provided on one side of the dust collector cover 123. The cover grip portion 1232 may be provided in a shape of a groove recessed to a predetermined depth. The user may open the dust collector cover 123 by inserting his/her hand into the recessed groove of the cover grip portion 1232 and gripping and lifting the cover grip portion 1232 up.

Referring to FIG. 6, although the embodiment of the present disclosure shows that the cover grip portion 1232 has a shape of a recessed groove, another embodiment may show that the cover grip portion 1232 has a shape of a protruding handle, and further another embodiment may show that the cover grip portion 1232 has a shape of a handle with an open center thereof. That is, various modifications of the shape can be made, and it is obvious that such modified embodiments are also included in the scope of the present disclosure.

The cover grip portion 1232 may be provided on the left or right side of the cover body 1231 on the basis of a direction in which the cleaner 20 is pushed in. Considering that the cleaner station 10 is typically disposed with a wall therebehind, the cover grip portion 1232 is disposed away from the wall, so that the user is able to grip the cover grip portion more conveniently.

The cover grip portion 1232 may be provided on one side of the left and right sides of the cover body 1231 where the connection tube 128 is not disposed. Accordingly, the connection tube 128 is not exposed to the outside in a state where the dust collector cover 123 is open.

The cover hinge 1233 may be provided on one side of the cover body 1231. The cover body 1231 may rotate about the cover hinge 1233 as an axis. In order that the user can conveniently pull out the dust collector 122 disposed in the inner space of the station body 120 to the outside, the cover hinge 1233 may be rotated by 90° or more. Accordingly, the cover body 1231 may be opened by rotating by 90° or more. Accordingly, in the state in which the dust collector cover 123 is open, the user can pull out the dust collector 122 without touching or colliding with the cover body 1231. However, in order to prevent the collision with the third body sidewall 1213, a rotation angle of the cover hinge 1233 may be limited to 180° or less.

The cover hinge 1233 may be disposed to face the cover grip portion 1232 with the cover body 1231 interposed therebetween. Accordingly, the cover body 1231 may be rotated about the cover hinge 1233 as a central axis by a force applied to the cover grip portion 1232. The user applies the force to the cover grip portion 1232 disposed from the cover hinge 1233, that is, a central axis, at a distance, thereby opening and closing the dust collector cover 123 by a smaller force.

Referring to FIG. 7, the dust collector 122 may be pulled out from the inside of the station body 120. Specifically, the dust collector 122 may be coupled to the coupling portion 129 provided within the station body 120 and may be separated from the coupling portion 129 and pulled out to the outside if necessary.

First, the configuration of the dust collector 122 will be described with reference to FIG. 10.

As described above, the dust collector 122 may collect dust sucked by the suction tube 126. Specifically, the dust within the dust bin of the cleaner may be collected within the dust collector 122 through the suction tube 126 and the connection tube 128.

The dust collector 122 according to the embodiment of the present disclosure may include a dust collector body 1221, a catching part 1222, and a dust inlet 1223.

The dust collector body 1221 may be selected from various components such as an envelope having an inner space capable of receiving dust, a bin, or a filter.

When a suction force is generated by the dust collection motor 127, the dust collector body 1221 may increase in volume and receive dust therein. To this end, the collector body 1221 may be made of a material that transmits air but does not transmit foreign substances such as dust. For example, the dust collector 122 may be made of a non-woven fabric material and may have an approximate hexahedral shape based on an increase in volume.

When the dust collection motor is operated, the dust collector body 1221 may be provided with a selected dust bag that is unfolded by negative pressure formed in the inner space of the station body 120. According to the embodiment, the volume of the dust collector body 1221 may be minimized in a state in which the dust collection motor is not operated. Accordingly, the user can store the unused dust collector 122 with a minimized volume.

The catching part 1222 may be connected to the dust collector body 1221 and may be provided in a flat plate shape.

The catching part 1222 may be inserted and coupled to a groove formed in the coupling portion 129. Specifically, guide rails 1291*a* and 1291*b* having a predetermined height are formed in the coupling portion 129, so that the catching part 1222 can be slidingly coupled. (See FIG. 8) A structure in which the catching part 1222 is coupled to the coupling portion 129 will be described in detail below.

The dust inlet 1223, that is, an open space, may be provided on an inner surface of the catching part 1222. The dust within the dust bin of the cleaner may be introduced into the dust inlet 1223 through the suction tube 126 and the connection tube 128. The dust inlet 1223 may have a circular shape with a predetermined radius, in response to the shape of the suction tube 126 or the connection tube 128.

The coupling portion 129 may be provided in the inner space of the station body 120, and the dust collector 122 may be coupled to the coupling portion 129. Also, the dust collector 122 may be separated from the coupling portion 129 by the user.

Referring to FIG. 8, the coupling portion 129 may include an insertion portion 1291, a pressing device 1292, a rotation protrusion 1293, an open hole 1294, an insertion portion hinge 1295, and a hook 1298.

The catching part 1222 of the dust collector 122 may be coupled to the insertion portion 1291. The insertion portion 1291 may be provided in a flat plate shape extending by a length corresponding to the left-right width of the catching part 1222.

A pair of the guide rails 1291*a* and 1291*b* may be provided on both sides of the insertion portion 1291 such that the catching part 1222 can be slidingly coupled. The guide rails 1291*a* and 1291*b* may be formed to protrude to have a certain height in response to the catching part 1222 having a predetermined thickness. The guide rails 1291*a* and 1291*b* may be provided in an approximately "ㄴ" shape (a quadrangular shape of which one side is open) when viewed from above. Accordingly, the user can slidingly couple the catching part 1222 of the dust collector 122 to the insertion portion 1291 and prevent the dust collector 122 from being separated from the insertion portion 1291.

The open hole 1294 may be provided such that the dust inlet 1223 and either the suction tube 126 or the connection tube 128 may communicate with each other in the state in which the catching part 1222 is coupled to the insertion portion 1291. The open hole 1294 may have a circular shape with a predetermined radius, in response to the shape of the dust inlet 1223, the suction tube 126, or the connection tube 128.

The insertion portion 1291 may be connected to the insertion portion hinge 1295 provided below in the direction of gravity. Referring to FIG. 8, the insertion portion 1291 may be rotated about the insertion portion hinge 1295 as a central axis, toward the inner space of the station body 120 by a predetermined angle. Therefore, the user has an advantage of being able to couple the catching part 1222 to the inclined insertion portion 1291 more conveniently.

The pressing device 1292 may be provided above the insertion portion 1291 on the basis of the direction of gravity of the insertion portion 1291. Referring to FIG. 6, the pressing device 1292 according to the embodiment of the present disclosure may be selected as a button. Accordingly, the user can operate the pressing device 1292 by applying pressure.

The pressing device 1292 may be exposed to the outside in a state in which the dust collector cover 123 is open. Also, the pressing device 1292 may be disposed to be exposed without being covered by the dust collector 122 in a state where the dust collector 122 is coupled to the coupling portion 129. Accordingly, in the state where the dust collector 122 is coupled to the coupling portion 129, the user may open the dust collector cover 123 and then may apply pressure to the pressing device 1292 exposed upward. (See FIG. 6)

Referring to FIGS. 7 and 8, the coupling portion 129 may further include the hook 1298. As described above, the insertion portion 1291 may be rotated about the insertion portion hinge 1295 as a central axis, toward the inner space of the station body 120 by a predetermined angle. Here, a plurality of the hooks 1298 may be disposed in order to prevent the rotation of the insertion portion 1291. That is, the plurality of hooks 1298 are provided so as to be caught in the rotation direction of the insertion portion 1291, thereby fixing the insertion portion 1291.

A pair of the hooks 1298 may be provided on the left and right sides of the insertion portion 1291, respectively. Also, a catching protrusion 1291*c* may be formed at left and right ends of the insertion portion 1291. Accordingly, the insertion portion 1291 may be fixed in a state where the locking protrusions 1291*c* on both sides of the insertion portion 1291 are caught by the hook 1298.

The hook 1298 is connected to the pressing device 1292. The fixing of the insertion portion 1291 can be released by that the user operates the pressing device 1292. Specifically, when the user applies pressure to the pressing device 1292, the hooks 1298 disposed on the left and right sides may be directed in the direction further away from each other. Here, the catching protrusion 1291*c* of the insertion portion 1291 caught by the hook 1298 may move. Accordingly, the catch and fixing of the insertion portion 1291 can be released.

When the fixing of the hook 1298 is released, the insertion portion 1291 may rotate with the upper portion thereof being inclined toward the inner space of the station body 120 and be disposed to be inclined. Accordingly, the user is able to couple the separated dust collector 122 to the coupling portion 129 again more conveniently.

The hook 1298 may also fix the coupling portion 129 in the state in which the dust collector 122 is coupled to the coupling portion 129.

Specifically, in the state where the catching part 1222 of the dust collector 122 has been coupled to the insertion portion 1291 of the coupling portion 129, the hook 1298 may fix the catching part 1222 and the insertion portion 1291 together. In a state in which the catching part 1222 is fitted to the guide rails 1291*a* and 1291*b* of the insertion portion 1291, the hook 1298 may catch both sides of the insertion portion 1291 and fix it. Accordingly, the catching part 1222 fitted to the insertion portion 1291 can be fixed together.

Referring to FIG. 8, when the pressing device 1292 is pressed downward by the user, the fixing of the hook 1298 can be released.

Specifically, the coupling portion 129 may be made of an elastic material that can be slightly deformed in shape and then return to its original shape again when a force is applied to the coupling portion 129. Here, when the user presses the pressing device 1292 from above, the coupling portion 129 of which the lower portion has been fixed may be elastically deformed by a predetermined interval in the left and right direction. Accordingly, the pair of hooks 1298 provided on both sides of the coupling portion 129 is moved in a direction in which the interval between the hooks increases, and the catching part 1222 fixed by the hook 1298 can be separated. The user may grip the unfixed dust collector 122 and pull it out.

Also, when the pair of hooks 1298 moves in the direction in which the interval between the hooks increases, the catching protrusion 1291*c* of the insertion portion 1291 caught on the hook 1298 may be separated.

Hereinafter, the function of the rotation protrusion 1293 according to the embodiment of the present disclosure will be described in detail with reference to FIGS. 9A and 9B.

The rotation protrusion 1293 may be provided at the uppermost end of the coupling portion 129. At least a portion of the rotation protrusion 1293 may be exposed to the outside of the station body 120. (See FIG. 9A) That is, the rotation protrusion 1293 may be disposed at the uppermost end of the cleaner station 10 in a state where the dust collector 122 is not coupled (see FIG. 9A), that is, in a state where the dust collector 122 is separated from the station body 120.

Also, when the dust collector 122 is coupled to the coupling portion 129, the rotation protrusion 1293 is rotated toward the inner space of the housing 121, that is, forward by a predetermined angle, so that the rotation protrusion 1293 can be concealed from the outside of the station body 120. (See FIG. 9B)

Specifically, the rotation protrusion 1293 may include a coupling limiter 1293*a* and a protrusion catching portion 1293*b*.

The coupling limiter 1293*a* is disposed with an end thereof exposed to the outside in the state in which the dust collector 122 is not coupled to the coupling portion 129. (See FIG. 9A) Therefore, it is possible to prevent the user from closing the dust collector cover 123 in the state in which the dust collector 122 is not coupled.

More specifically, the coupling limiter 1293*a* may be disposed to protrude upward on the basis of a position where the dust collector cover 123 is closed. Accordingly, when the user moves down the dust collector cover 123 in order to close the dust collector cover 123 in the state in which the dust collector 122 is not coupled, the dust collector cover 123 is caught by the coupling limiter 1293*a* and the coupling is limited.

If the dust collector cover 123 is closed in a state in which the dust collector 122 is not coupled to the station body 120, the user cannot check visually whether the dust collector 122 is coupled. Here, when the user regards the dust collector 122 as being coupled and operates the cleaner station 10, dust or foreign substances may be sucked as they are, and thus, a HEPA filter, a pre-filter or the like may be blocked and damaged. Also, in a state where the filter is not provided, dust or foreign substances may be sucked into the dust collection motor 127 and the dust collection motor 127 is damaged.

The cleaner station according to the embodiment of the present disclosure includes the rotation protrusion 1293, thereby preventing the dust collector cover 123 from being coupled in the state in which the dust collector 122 is not coupled. Therefore, the user can intuitively recognize with the naked eye that the dust collector 122 is not coupled, and thus, the above-described problems can be solved.

The protrusion catching portion 1293*b* may have an approximate "T" shape in cross section. (See FIG. 8) When the dust collector 122 is coupled, the protrusion catching portion 1293*b* may generate a rotational force by being caught by the catching part 1222. That is, the rotation protrusion 1293 may be rotated by that the protrusion catching portion 1293*b* is caught by the dust collector 122.

Referring to FIG. 8, when the dust collector 122 is inserted and coupled to the coupling portion 129, an upper portion of the insertion portion 1291 may be rotated toward the connection tube 128, that is, toward the rear. Here, an upper protrusion 1291*d* may be provided at one side end of the upper portion of the insertion portion 1291.

The upper protrusion 1291*d* may be provided at a position that enables the upper protrusion 1291*d* to come into contact with the protrusion catching portion 1293*b*. Accordingly, when the insertion portion 1291 moves backward, the upper protrusion 1291*d* may push the protrusion catching portion 1293*b* backward and rotate it.

By the rotation of the protrusion catching portion 1293*b*, the coupling limiter 1293*a* may rotate together. Therefore, when the dust collector 122 is coupled, the rotation protrusion 1293 may be concealed from the outside. Accordingly, the user may close the dust collector cover 123 without touching or colliding with the rotation protrusion 1293.

The coupling portion 129 may further include a fixing pin 1296 for guiding the position of the rotation protrusion 1293.

Referring to FIG. 8, in order to limit the rotation of the rotation protrusion 1293, the fixing pin 1296 may be disposed in a direction in which the rotation protrusion 1293 rotates. Accordingly, the rotation protrusion 1293 may maintain the state in which the coupling limiter 1293*a* is exposed to the outside of the station body 120.

Referring to FIG. 9B, when the dust collector 122 is coupled to the coupling portion 129, the position fixing of the rotation protrusion 1293 by the fixing pin 1296 may be released.

Specifically, when the dust collector 122 is fitted to the coupling portion 129, the rotation protrusion 1293 may be rotated by the catching part 1222. Here, the fixing pin 1296 may release the fixing of the rotation protrusion 1293 when a force greater than a predetermined force is applied to the fixing pin 1296.

In the embodiment of the present disclosure, the method in which the fixing pin 1296 releases the fixing of the rotation protrusion 1293 may be variously selected. For example, the fixing pin 1296 may be connected to a rotating shaft 1297 to be described below and be rotatable together with the rotation protrusion 1293.

As another example, referring to FIG. 9B, when the user operates the pressing device 1292, the fixing pin 1296 may be pushed into the inside of the rotating shaft 1297. That is, when the user presses the pressing device 1292 downward, the fixing pin 1296 is concealed within the rotating shaft 1297, so that the rotation protrusion 1293 can freely rotate.

The rotating shaft 1297 may be connected to the rotation protrusion 1293 and be rotatable together with the rotation protrusion 1293. Also, the rotating shaft 1297 may be connected to the fixing pin 1296.

In order to more stably support the rotation protrusion 1293, at least a portion of the rotating shaft 1297 may be coupled between the coupling limiter 1293*a* and the protrusion catching portion 1293*b*.

Although the foregoing has described a specific embodiment of the present disclosure, it can be understood by those skilled in the art that the present disclosure is not limited to the illustrated embodiment and can be variously changed and modified to other specific embodiments without departing from the spirit and scope of the present disclosure. Therefore, the scope of the present disclosure should be determined not by the described embodiments but by the spirit as defined by the appended claims.

The invention claimed is:

1. A cleaner station comprising:

a docking unit where a cleaner enters and is docked; and a station body configured to be connected to one side of the docking unit and process dust within a dust bin of the cleaner, wherein the station body comprises:

a housing;

a suction tube configured to be coupled to the docking unit and to suck the dust within the dust bin of the cleaner;

a dust collector configured to collect the dust sucked by the suction tube; and a coupling portion which is configured to be provided within the housing and to which the dust collector is coupled, wherein the housing comprises a dust collector cover that is openable and closeable such that the dust collector enters and exits, wherein the coupling portion comprises a rotation protrusion of which at least a portion is exposed to the outside of the station body, wherein, when the dust collector is coupled, the rotation protrusion is rotated and is concealed from the outside, and wherein the coupling portion further comprises a fixing pin that guides a position of the rotation protrusion.

2. The cleaner station of claim 1, wherein the dust collector cover is disposed above the dust collector on the basis of the direction of gravity of the dust collector.

3. The cleaner station of claim 1, wherein the coupling portion further comprises an insertion portion that is hinge-coupled to an inner surface of the station body, and wherein the dust collector comprises:

a dust collector body configured to form an inner space where dust is collected; and a catching part configured to be connected to the dust collector body and is coupled to the insertion portion.

4. The cleaner station of claim 3, wherein the insertion portion has a groove in which the catching part is fitted and received.

5. The cleaner station of claim 3, wherein the coupling portion further comprises:

a pressing device disposed above the insertion portion; and at least one hook configured to fix the insertion portion, and wherein, when a user presses the pressing device, the at least one hook releases the fixing of the insertion portion.

6. The cleaner station of claim 3, wherein the insertion portion is provided to be rotated by a predetermined angle about an insertion portion hinge connected to a lower portion thereof.

7. The cleaner station of claim 3, wherein the coupling portion further comprises at least one hook configured to fix the insertion portion, and wherein the at least one hook catches and fixes the catching part and the insertion portion together.

8. The cleaner station of claim 7, wherein the coupling portion further comprises a pressing device disposed above the insertion portion, and wherein, when a user presses the pressing device, the at least one hook releases the fixing of the catching part from the insertion portion.

9. The cleaner station of claim 1, wherein the coupling portion further comprises a pressing device configured to be disposed above the insertion portion, and wherein, when a user presses the pressing device, the fixing pin releases the fixing of the rotation protrusion.

10. The cleaner station of claim 1, wherein the dust collector cover comprises:

a cover body;

a cover grip portion provided on one side of the cover body; and a cover hinge provided on the other side of the cover body, facing the cover grip portion.

11. The cleaner station of claim 10, wherein the cover grip portion is provided in a shape of a groove recessed to a predetermined depth such that a user is able to grip the cover grip portion.

12. The cleaner station of claim 10, wherein the cover is rotatable about the cover hinge at a central axis by 90° or more and 180° or less on the basis of a state of being closed.

13. A cleaner station comprising:

a docking unit where a cleaner enters and is docked; and a station body configured to be connected to one side of the docking unit and process dust within a dust bin of the cleaner, wherein the station body comprises:

a housing;

a suction tube configured to be coupled to the docking unit and to suck the dust within the dust bin of the cleaner;

a dust collector configured to collect the dust sucked by the suction tube; and a coupling portion which is configured to be provided within the housing and to which the dust collector is coupled, and wherein the coupling portion is disposed such that an upper portion thereof is inclined toward an inner space of the housing at a predetermined angle, in a state of being separated from the dust collector, and wherein the coupling portion includes:

a rotation protrusion of which at least a portion is exposed outside of the station body, and a fixing pin that guides a position of the rotation protrusion.

* * * * *